US008072126B2

(12) United States Patent
Chen et al.

(10) Patent No.: US 8,072,126 B2
(45) Date of Patent: Dec. 6, 2011

(54) FIELD ELECTRON EMISSION SOURCE HAVING CARBON NANOTUBES AND METHOD FOR MANUFACTURING THE SAME

(75) Inventors: Zhuo Chen, Beijing (CN); Feng Zhu, Beijing (CN); Kai-Li Jiang, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 384 days.

(21) Appl. No.: 12/220,369

(22) Filed: Jul. 24, 2008

(65) Prior Publication Data

US 2009/0079320 A1 Mar. 26, 2009

(30) Foreign Application Priority Data

Sep. 14, 2007 (CN) ..... 2007 1 0077114

(51) Int. Cl.
*H01J 9/02* (2006.01)
*H01J 9/00* (2006.01)

(52) U.S. Cl. ..... 313/310; 313/309; 313/311; 445/23; 445/24; 445/25

(58) Field of Classification Search ..... 445/23–25; 313/309, 311, 495–497, 310
See application file for complete search history.

(56) References Cited

U.S. PATENT DOCUMENTS

| | | | | |
|---|---|---|---|---|
| 6,239,547 | B1 * | 5/2001 | Uemura et al. | 313/495 |
| 6,733,355 | B2 * | 5/2004 | Hwang et al. | 445/24 |
| 7,537,505 | B2 * | 5/2009 | Shiroishi et al. | 445/50 |
| 2003/0117065 | A1 * | 6/2003 | Okai et al. | 313/496 |

FOREIGN PATENT DOCUMENTS

JP P2000-36243 A 2/2000

* cited by examiner

*Primary Examiner* — Joseph L Williams
*Assistant Examiner* — Nathaniel Lee
(74) *Attorney, Agent, or Firm* — Altis Law Group, Inc.

(57) ABSTRACT

An exemplary method for manufacturing a field electron emission source includes: providing a substrate (102); depositing a cathode layer (104) on a surface of the substrate; providing a carbon nanotube paste, coating the carbon nanotube paste on the cathode layer; calcining the carbon nanotube paste to form a carbon nanotube composite layer (110); and, irradiating the carbon nanotube composite layer with a laser beam of a certain power density, thereby achieving a field electron emission source.

20 Claims, 5 Drawing Sheets

FIELD ELECTRON EMISSION SOURCE HAVING CARBON NANOTUBES AND METHOD FOR MANUFACTURING THE SAME

BACKGROUND

1. Field of the Invention

The present invention relates to field electron emission sources having carbon nanotubes and methods for manufacturing the same.

2. Discussion of Related Art

Field emission displays (FEDs) are a relatively new and rapidly developing flat panel display technology. Compared to conventional technologies, e.g., cathode-ray tube (CRT) and liquid crystal display (LCD) technologies, field emission displays are superior in having a wider viewing angle, lower energy consumption, a smaller size, and a higher quality display. A field electron emission source is an essential component in FEDs and has been widely investigated in recent years.

Carbon nanotubes (CNTs) are very small tube-shaped structures, essentially having a composition of a graphite sheet rolled into a tube. CNTs produced by arc discharge between graphite rods were discovered and reported in an article by Sumio Iijima entitled "Helical Microtubules of Graphitic Carbon" (Nature, Vol. 354, Nov. 7, 1991, pp. 56-58). CNTs have extremely high electrical conductivity, very small diameters (much less than 100 nanometers), large aspect ratios (i.e. length/diameter ratios greater than 1000), and a tip-surface area near the theoretical limit (the smaller the tip-surface area, the more concentrated the electric field and the greater the field enhancement factor). Thus, CNTs can transmit an extremely high electrical current and have a very low turn-on electric field (approximately 2 volts/micron) for emitting electrons. In summary, CNTs are among the most favorable candidates for electron emission terminals of a field electron emission source, and can play an important role in FED applications.

A conventional method for manufacturing the field electron emission source utilizes a screen-printing process. In this method, a CNT paste having CNTs and conductive paste is formed on a cathode and then calcined to form a CNT composite layer. Most CNTs embedded in the CNT composite layer cannot emit electrons. For this reason, a surface of the CNT composite layer is cut and polished to form electron emission portions. However, in this mechanical method, the formation of the electron emission portions cannot be accurately controlled. Further, the field electron emission source has a low field electron emission efficiency due to a shielding effect caused by closer, adjacent CNTs.

Therefore an accurately controlled method for manufacturing field electron emission sources and a field electron emission source with high field electron emission efficiency are desired to overcome the above-described problems.

SUMMARY

A method for manufacturing a field electron emission source includes: providing a substrate and depositing a cathode layer on a surface of the substrate; providing a carbon nanotube paste and coating the carbon nanotube paste on the cathode layer; calcining the carbon nanotube paste to form a carbon nanotube composite layer; and, irradiating the carbon nanotube composite layer with a laser beam of a certain power density, thereby achieving a field electron emission source.

The present method for manufacturing the field electron emission source can have the following advantages over conventional methods. First, the method can be performed rapidly and easily due to a high energy density of the laser beam. Secondly, the field electron emission source has a high resolution because the laser beam creates a sharp edge on the electron emission portion. Thirdly, the electron emission portions of the field electron emission source can be accurately selected by controlling the movement of the laser beam. Lastly, the field electron emission source has high field emission efficiency due to protruding CNTs in the electron emission portion.

Other advantages and novel features of the present method and a related field electron emission source will become more apparent from the following detailed description when taken in conjunction with the accompanying drawings.

BRIEF DESCRIPTION OF THE DRAWINGS

Many aspects of the present method for manufacturing a field electron emission source and of the present field electron emission source may be best understood with reference to the following drawings. The components in the drawings are not necessarily drawn to scale. Instead, the emphasis is placed upon clearly illustrating the principles of the present method and field electron emission source.

DETAILED DESCRIPTION OF PREFERRED EMBODIMENTS

Reference will now be made to the drawings to describe preferred and exemplary embodiments of the present invention in detail.

Figure 1:
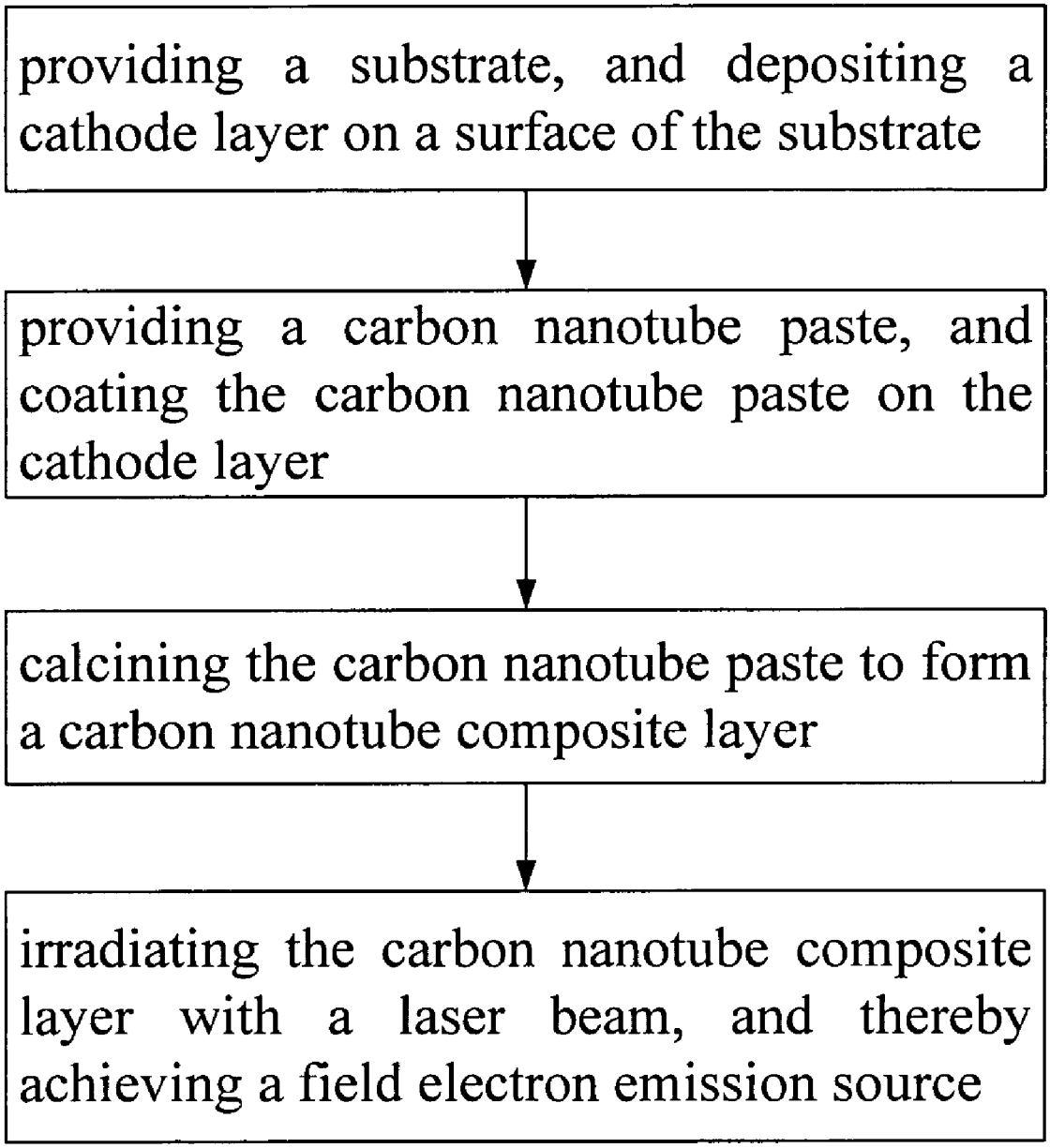
FIG. 1 is a flow process chart, showing a method for manufacturing a field electron emission source according to one embodiment.

Referring to FIG. 1, a method for manufacturing a field electron emission source includes the steps of:

(a) providing a substrate, and depositing a cathode layer on a surface of the substrate;

(b) providing a carbon nanotube (CNT) paste and coating the CNT paste on the cathode layer;

(c) calcining the CNT paste to form a CNT composite layer; and (d) irradiating the CNT composite layer with a laser beam of a certain power density, thereby achieving a field electron emission source.

In step (a), a pattern of the cathode layer is deposited in a predetermined region on a surface of the substrate by a conventional method, such as the sputtering method. The substrate can be made of any suitable material, e.g., glass, plastic, or metal. The cathode layer is made of one or more conductive metal materials, e.g., gold, silver, copper, or any one of their alloys.

In step (b), the CNT paste is prepared by mixing CNTs in a known conductive paste, such as a silver paste. CNTs account for about 5%-15% of the total mass of CNT paste.

CNTs can be obtained by a conventional method, such as chemical vapor deposition, arc discharging, or laser ablation. The lengths of the CNTs range from about 5 microns (μm) to about 15 μm. The CNT paste can be coated on the cathode layer using a screen-printing method.

In step (c), solvent and volatile components of the CNT paste are first volatilized. Then, the resultant paste is calcined in air or in vacuum at about $1^{-10}$ torr, for a period of about 15 to 60 minutes. Thereafter, the CNT paste is transformed into a CNT composite layer on the cathode layer, and the CNT composite layer becomes firmly attached to the cathode layer. In the CNT composite layer, CNTs are uniformly embedded and rarely exposed on the surface.

In step (d), the high power density laser beam irradiates a selective portion of the surface of the CNT composite layer, thereby increasing the temperature of the selected portion rapidly. The portion of the CNT composite layer expands and forms a protrusion (i.e., both CNTs and the resultant paste protrude). Meanwhile, a part of the resultant paste of the CNT composite layer is removed by a laser beam to expose CNTs in the protrusion which function as electron-emitting terminals when a current flows through. As a result, the shielding effect of the adjacent CNTs is reduced, and accordingly, the field emission efficiency of the CNTs is improved. The power density of the laser beam is about $10^4$-$10^5$ W/mm$^2$ (watts per square millimeter), ideally, around $7\times10^4$ W/mm$^2$. If the power density of the laser beam is insufficient, a groove is formed in the CNT composite layer, and CNTs thereby become exposed in the groove with terminals of the CNTs being lower than the CNT composite layer. In such case, the shielding effect of adjacent CNTs and the like are increased, and the CNTs cannot emit electrons efficiently. If the power density of the laser beam is excessive, CNTs fuse. The laser beam can be moved along a predetermined route to form a pattern of the protrusions including exposed CNTs in a corresponding region on the surface of the CNT composite layer. The moving rate of the laser beam should be approximately 800 mm/s (millimeters per second) to 1500 mm/s, ideally, around 1000 mm/s. The route of the laser beam can be accurately controlled by a computer.

Figure 2:
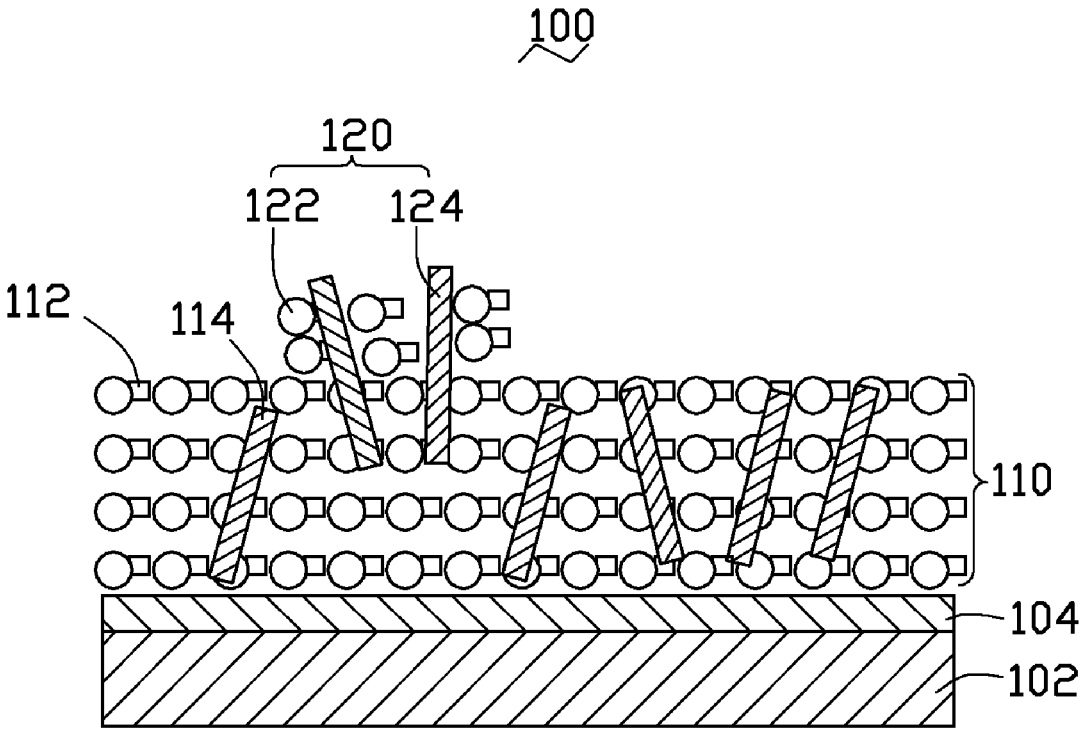
FIG. 2 is a schematic, cross-sectional view of a field electron emission source according to one embodiment.

Referring to FIG. 2, a field electron emission source 100 manufactured by the method in FIG. 1 is shown. The field electron emission source 100 includes a substrate 102, a cathode layer 104 deposited on the substrate 102, and a CNT composite layer 110 coated on the cathode layer 104. The CNT composite layer 110 includes a conductive paste 112 and CNTs 114. The surface of the CNT composite layer 110 includes at least one protrusion 120. The protrusion 120 includes a resultant paste 122 and CNTs 124. At least one CNT 124 protrudes out from a top of the protrusion 120. The protruded CNTs are higher than the CNT composite layer 110 by 8-12 microns.

Figure 3:
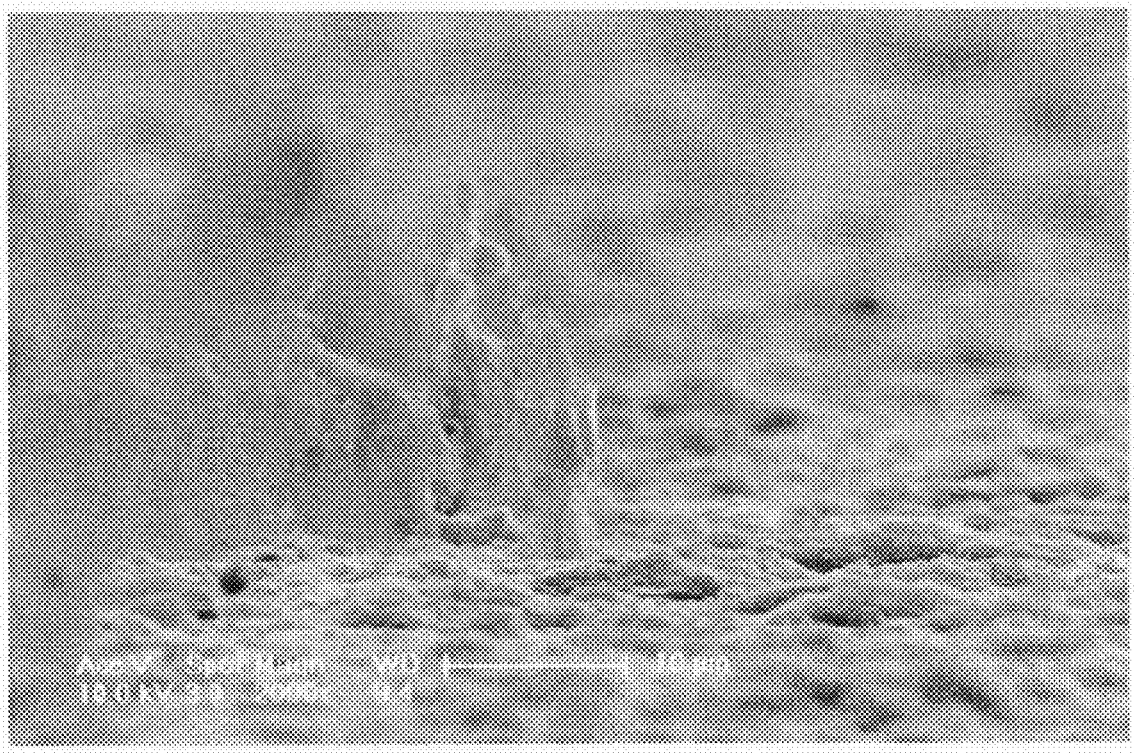
FIG. 3 is a Scanning Electron Microscope (SEM) image, showing a CNT composite layer of the field electron emission source of FIG. 2.
Figure 4:
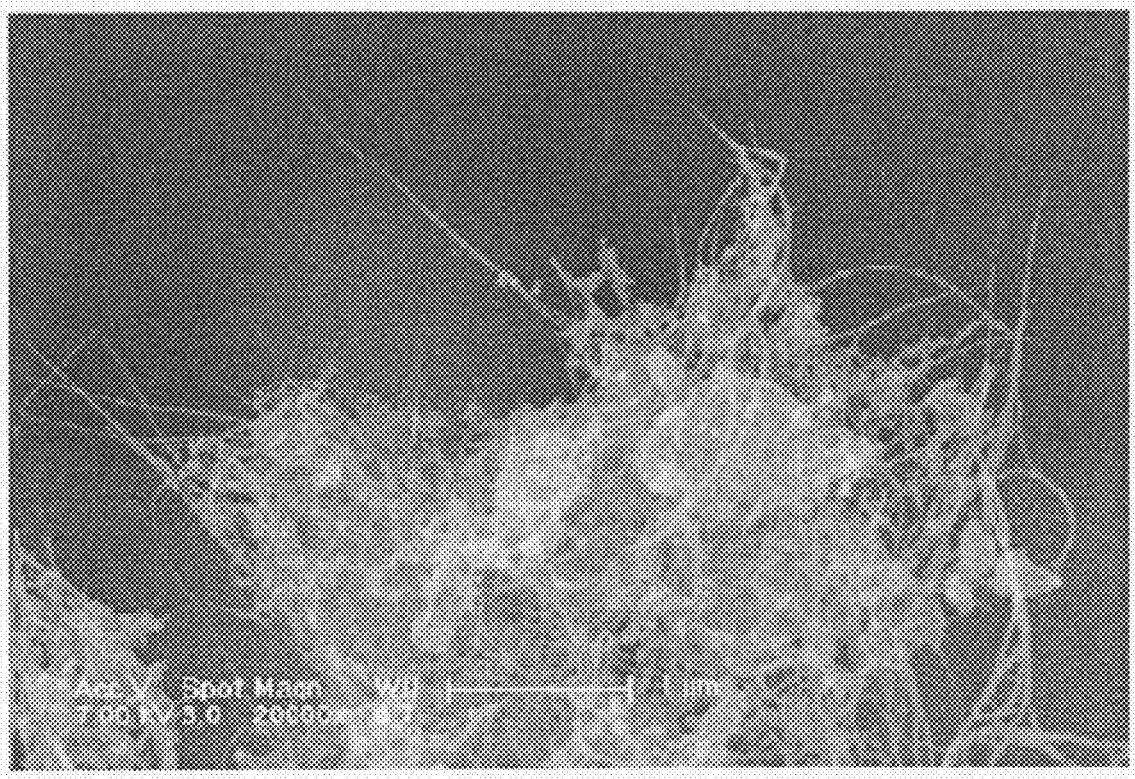
FIG. 4 is an SEM image, showing a protrusion of a CNT composite layer of the field electron emission source of FIG. 2.
Figure 5:
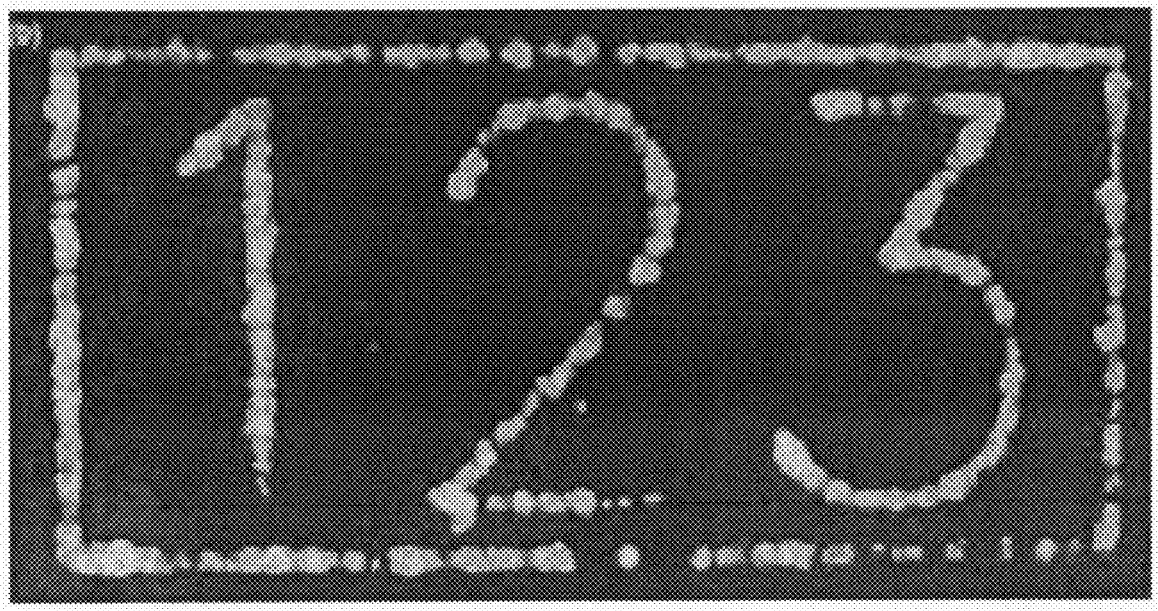
FIG. 5 is a photo showing the field electron emission source in a working state.

Referring to FIGS. 3 and 4, a scanning electron microscope (SEM) image of the field electron emission source and an amplified SEM image of the protruded CNTs are shown, respectively. Referring to FIG. 5, the field electron emission source is shown in a working state.

It is believed that the present embodiments and their advantages will be understood from the foregoing description, and it will be apparent that various changes may be made thereto without departing from the spirit or scope of the invention or sacrificing all of its material advantages, the examples hereinbefore described merely being preferred or exemplary embodiments of the invention.

What is claimed is:

1. A method for manufacturing a field electron emission source, comprising:

providing a substrate, and depositing a cathode layer on a surface of the substrate;

providing a carbon nanotube paste, and coating the carbon nanotube paste on the cathode layer;

calcining the carbon nanotube paste to form a carbon nanotube composite layer; and irradiating the carbon nanotube composite layer with a laser beam, and thereby achieving a field electron emission source, a power density of the laser beam is about $10^4$ W/mm$^2$ to about $10^5$ W/mm$^2$, a moving rate of the laser beam is about 800 mm/s to about 1500 mm/s.

2. The method of claim 1, wherein the cathode layer is deposited on the substrate by a sputtering method.

3. The method of claim 1, wherein the substrate is made of a material selected from the group consisting of glass, plastic, and metal.

4. The method of claim 1, wherein the cathode layer is made of a material selected from the group consisting of gold, silver, copper, and their alloys.

5. The method of claim 1, wherein the carbon nanotube paste is prepared by mixing carbon nanotubes in a conductive paste.

6. The method of claim 5, wherein the conductive paste is silver paste.

7. The method of claim 5, wherein a mass percent of carbon nanotubes in the carbon nanotube paste is about 5%-15%.

8. The method of claim 5, wherein a length of carbon nanotubes is about 5-15 microns.

9. The method of claim 1, wherein the carbon nanotube paste is calcined in air or in vacuum for approximately 15 to 60 minutes.

10. The method of claim 1, wherein the laser beam irradiates a selective portion of a surface of the carbon nanotube composite layer.

11. The method of claim 1, wherein the power density and the moving rate of the laser beam is such that at least one protrusion is formed on the carbon nanotube composite layer of the field electron emission source, the at least one protrusion comprises carbon nanotubes and a resultant past, with at least one carbon nanotube protruded from the at least one protrusion.

12. A field electron emission source comprising:

a substrate;

a cathode layer deposited on the substrate; and a carbon nanotube composite layer coated on the cathode layer, the carbon nanotube composite layer comprising at least one protrusion higher than an original top surface of the carbon nanotube composite layer, the at least one protrusion comprising carbon nanotubes and a conductive paste, the carbon nanotubes comprising at least one protruding carbon nanotube protruding from the at least one protrusion.

13. The field electron emission source of claim 12, wherein the carbon nanotube composite layer comprises carbon nanotubes and a conductive paste.

14. The field electron emission source of claim 13, wherein a weight ratio of the carbon nanotubes in the carbon nanotube composite layer is in an approximate range form 5% to 15%.

15. The field electron emission source of claim 12, wherein the at least one protruding carbon nanotube is higher than the carbon nanotube composite layer by about 8 microns to about 12 microns.

16. The field electron emission source of claim 12, wherein the at least one protrusion comprises a plurality of protrusions constituting a desired pattern.

17. A method for manufacturing a field electron emission source, comprising:

providing a substrate, and a carbon nanotube paste comprising carbon nanotubes and a conductive paste mixed together;

depositing a cathode layer on a surface of the substrate;

coating the cathode layer with the carbon nanotube paste;

calcining the carbon nanotube paste to form a carbon nanotube composite layer having an original top surface; and forming at least one protrusion protruding from the original top surface of the carbon nanotube composite layer by irradiating the carbon nanotube composite layer with a laser beam, at least one carbon nanotube protruded from the at least one protrusion.

18. The method of claim 17, wherein a power density of the laser beam is about $10^4$ W/mm$^2$ to about $10^5$ W/mm$^2$, and a moving rate of the laser beam is about 800 mm/s to about 1500 mm/s.

19. The method of claim 17, wherein both the carbon nanotubes and the conductive paste protrude from the original top surface of the carbon nanotube composite layer.

20. The method of claim 17, wherein the erecting step further comprises a step of forming a desired pattern of protrusions on the original top surface of the carbon nanotube composite layer by irradiating the carbon nanotube composite layer with the laser beam on a route in accordance with the desired pattern.

* * * * *